US005123705A

United States Patent [19]

Johnson

[11] Patent Number: 5,123,705

[45] Date of Patent: Jun. 23, 1992

[54] SOFA WITH INVERTIBLE OTTOMAN EXTENSION

[75] Inventor: Maynard L. Johnson, Madison, Wis.

[73] Assignee: Schweiger Industries, Inc., Jefferson, Wis.

[21] Appl. No.: 598,388

[22] Filed: Oct. 17, 1990

[51] Int. Cl.[5] ..... A47C 9/12

[52] U.S. Cl. ..... 297/439; 297/283; 297/248; 297/111; 108/62

[58] Field of Search ..... 297/3, 111, 223, 248, 297/249, 232, 283, 429, 461, 130, 439; 5/465; 108/13, 62, 12, 19; 211/1.3; 248/188.8

[56] References Cited

U.S. PATENT DOCUMENTS

| | | | |
|---|---|---|---|
| 155,706 | 10/1874 | Cahill | 297/283 |
| 191,733 | 6/1877 | True . | |
| 473,937 | 5/1892 | Lehmann | 297/111 |
| 890,859 | 6/1908 | Harris . | |
| 1,450,283 | 4/1923 | Galizia | 297/283 |
| 2,544,787 | 3/1951 | Hand | 297/3 |
| 2,602,012 | 7/1952 | Doty | 108/62 |
| 3,084,975 | 4/1963 | Winrow | 297/439 X |
| 3,744,845 | 7/1973 | Sooker | 297/439 |
| 3,890,658 | 6/1975 | Petersilie | 5/465 X |
| 4,077,666 | 3/1978 | Heumann | 297/248 X |
| 4,765,678 | 8/1988 | Huang . | |

FOREIGN PATENT DOCUMENTS

| | | | |
|---|---|---|---|
| 266323 | 12/1951 | Switzerland . | |
| 454014 | 9/1936 | United Kingdom . | |
| 486553 | 6/1938 | United Kingdom | 297/283 |

*Primary Examiner*—Peter A. Aschenbrenner
*Attorney, Agent, or Firm*—Michael, Best & Friedrich

[57] ABSTRACT

A sofa apparatus comprising a sofa section including opposite end portions each having a nonlinear, nonsymmetrical, forwardly facing surface portion, the forwardly facing surface portions being mirror images of each other, and an invertible ottoman section including opposed, generally horizontal first and second surfaces, and a nonlinear, nonsymmetrical, rearwardly facing surface portion extending between the first and second surfaces, the ottoman section being positionable in a first position wherein the first surface faces upwardly, the second surface faces downwardly, and the rearwardly facing surface portion is positioned in closely adjacent complementary relation with one of the forwardly facing surface portions, and the ottoman being positionable in a second position wherein the second surface faces upwardly, the first surface faces downwardly, and the rearwardly facing surface portion is positioned in closely adjacent complementary relation with the other of the forwardly facing surface portions.

13 Claims, 3 Drawing Sheets

SOFA WITH INVERTIBLE OTTOMAN EXTENSION

BACKGROUND OF THE INVENTION

1. Field of the Invention

The present invention relates generally to furniture, and more particularly to sofa apparatus.

2. Background of the Prior Art

Sofas, couches, or chaise lounges, as they are sometimes called, conventionally include a seating area which is generally surrounded on three sides by a backrest and a pair of opposite arm rests. The seating area is typically provided with seat cushions.

Ottomans are conventionally used as foot stools and can be positioned near the sofa or another piece of furniture. L-shaped sofas are also known.

SUMMARY OF THE INVENTION

The invention provides a sofa apparatus comprising a sofa section including opposite end portions each having a nonlinear, nonsymmetrical, forwardly facing surface portion, the forwardly facing surface portions being mirror images of each other, and an invertible ottoman section including opposed, generally horizontal first and second surfaces, and a nonlinear, nonsymmetrical, rearwardly facing surface portion extending between the first and second surfaces, the ottoman section being positionable in a first position wherein the first surface is upwardly facing, the second surface is downwardly facing, and the rearwardly facing surface portion is positioned in closely adjacent complementary relation with one of the forwardly facing surface portions, and the ottoman section being positionable in a second position wherein the second surface is upwardly facing, the first surface is downwardly facing, and the rearwardly facing surface portion is positioned in closely adjacent complementary relation with the other of the forwardly facing surface portions.

The invention also provides an ottoman for use with a sofa including opposite end portions each having a nonlinear, nonsymmetrical, forwardly facing surface portion, the forwardly facing surface portions being mirror images of each other, the ottoman comprising opposed, generally horizontal first and second surfaces, and a nonlinear, nonsymmetrical, generally vertical third surface portion extending between the first and second surfaces, the ottoman being positionable in a first position wherein the first surface faces upwardly, the second surface faces downwardly, and the third surface portion is positioned in closely adjacent complementary relation with one of the forwardly facing surface portions of the sofa, and the ottoman being positionable in a second position wherein the second surface faces upwardly, the first surface faces downwardly, and the third surface portion is positioned in closely adjacent complementary relation with the other of the forwardly facing surface portions of the sofa.

The invention also provides an ottoman comprising, opposed, generally horizontal first and second surfaces, a plurality of support members, and means for selectively and alternatively attaching the support members to the first surface and the second surface.

A principal feature of the invention is the provision of an invertible ottoman which has a nonlinear, nonsymmetrical, and preferably curvilinear surface portion that matches one or the other of the opposite ends of a sofa so that the ottoman can be placed adjacent one end of the sofa or inverted and placed adjacent the other end of the sofa to provide an extension of the sofa.

Another principal feature of the invention is the provision of a generally L-shaped sofa apparatus including a sofa section and an ottoman section which can be alternatively positioned on either end of the sofa section to form the L-shape.

Other features and advantages of the invention will become apparent to those skilled in the art upon review of the following detailed description, claims, and drawings.

Figure 1:
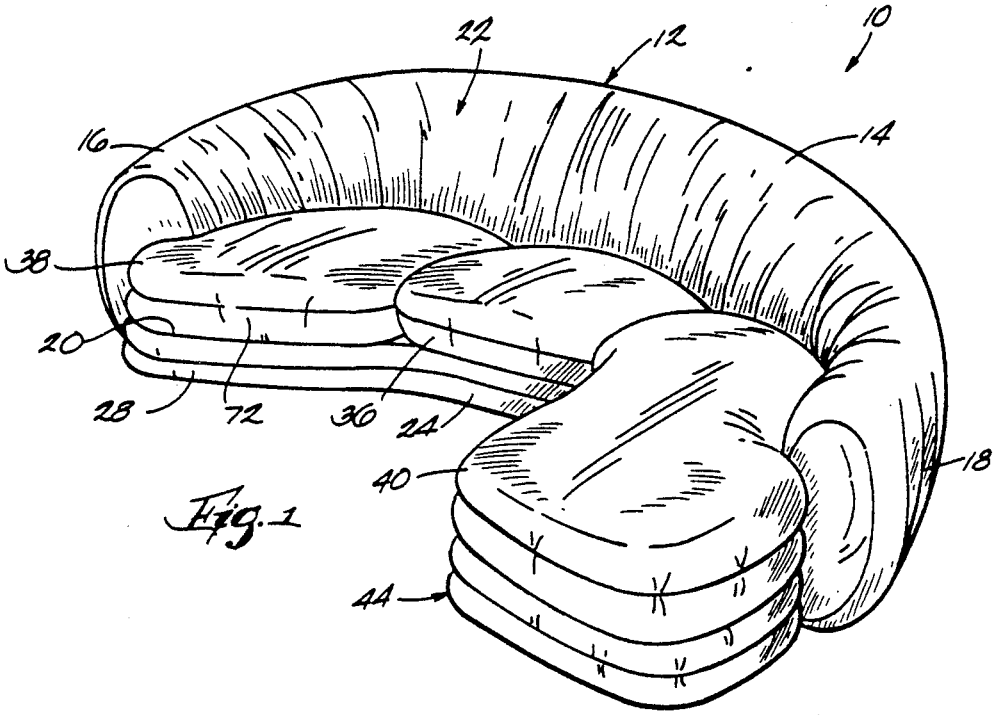
FIG. 1 is a perspective view of a sofa apparatus which is shown with an ottoman section on the right end thereof and which embodies various of the features of the invention.
Figure 2:
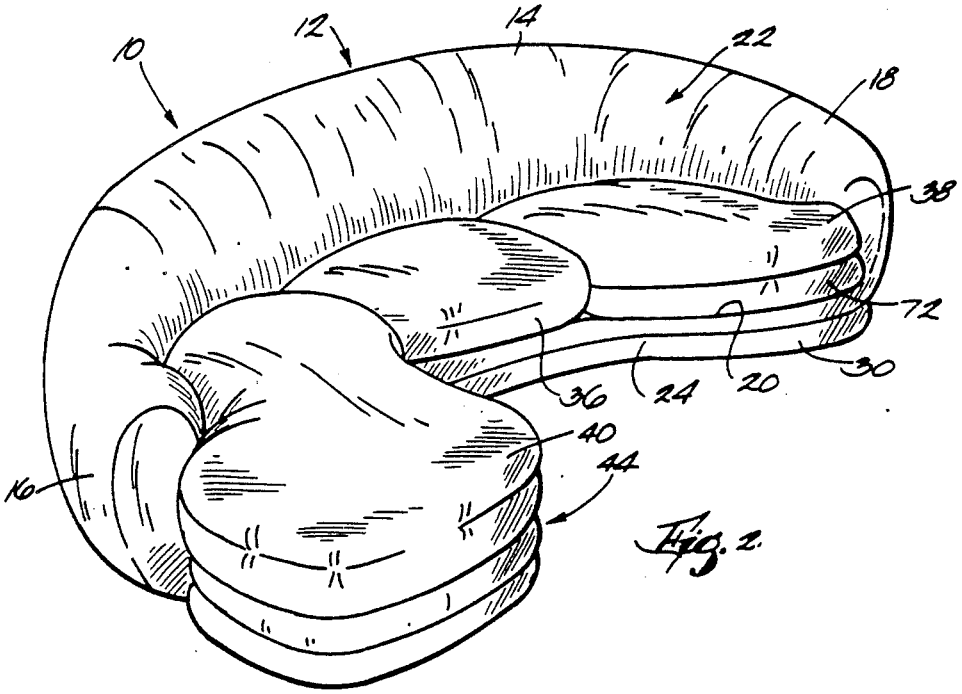
FIG. 2 is a view similar to FIG. 1, and shown with the ottoman section on the left end of the sofa apparatus.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

A sofa apparatus 10 embodying various features of the invention is illustrated in the drawings. The sofa apparatus 10 includes a love seat or sofa section 12 which has a backrest 14 at the rear of the sofa section 12, and a pair of armrests 16 and 18 on opposite left and right ends of the sofa section 12. In the illustrated arrangement, the armrests 16 and 18 are coextensive with the backrest 14.

Figure 3:
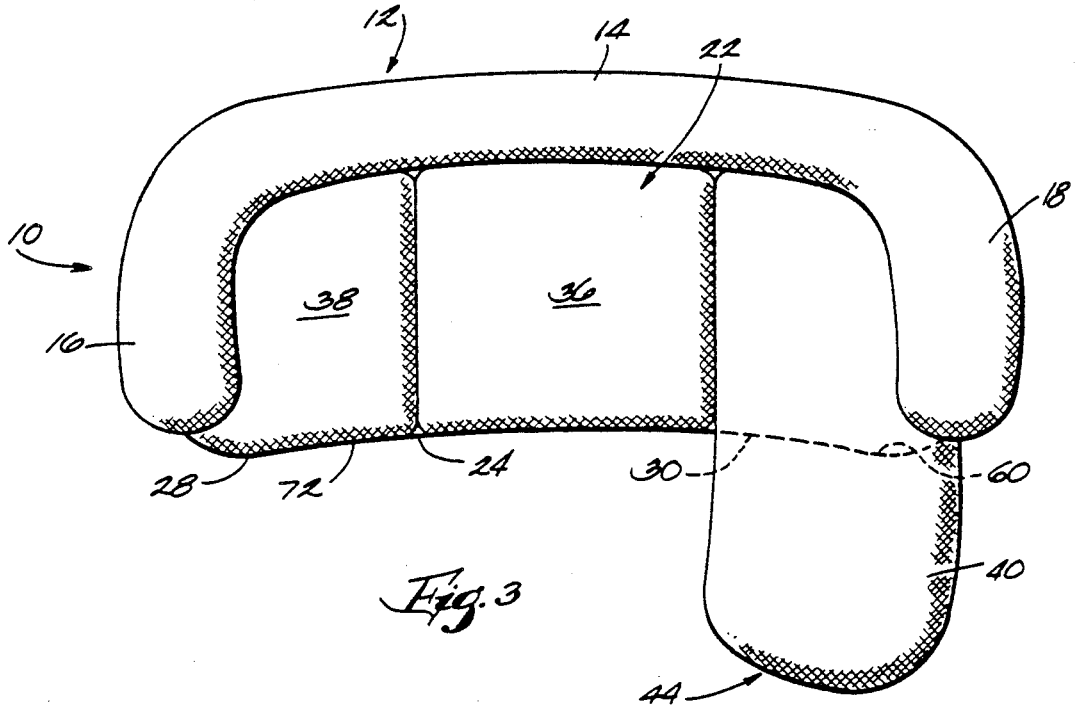
FIG. 3 is a reduced top plan view of the sofa apparatus as shown in FIG. 1.
Figure 6:
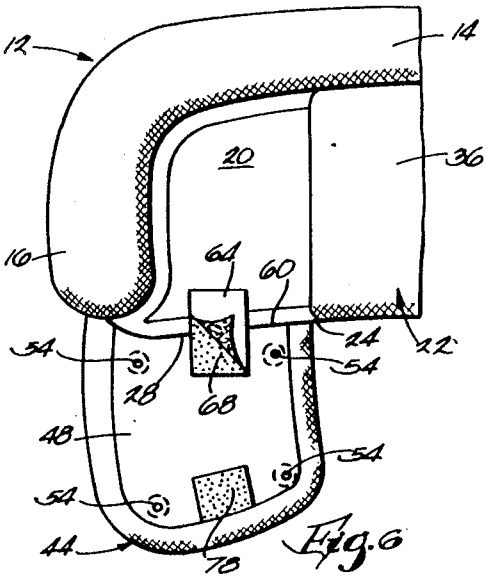
FIG. 6 is a top view of the left end of the sofa apparatus shown in FIG. 4, and shown with a seat cushion removed.
Figure 5:
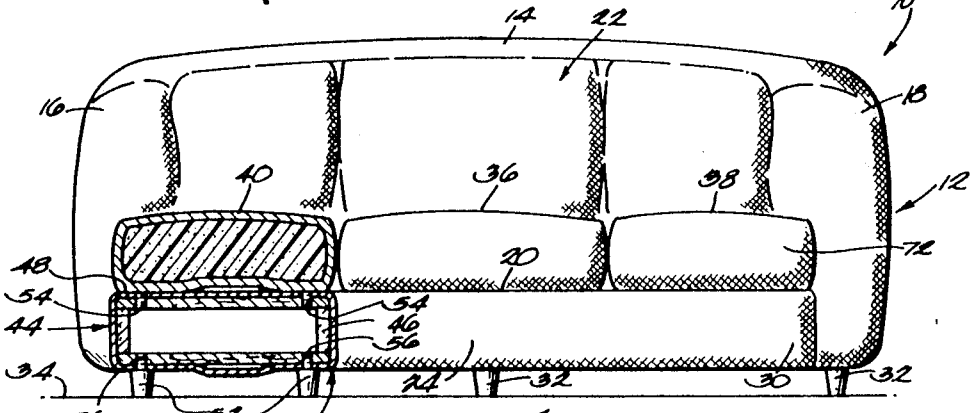
FIG. 5 is a view taken along line 5—5 in FIG. 4.

The sofa section 12 also includes opposite end portions adjacent the opposite ends of the sofa section 12, and a generally horizontal support surface 20 which extends forwardly from the backrest 14, and which defines a seating area 22 thereabove (see FIGS. 5 and 6). A forwardly facing surface 24 extends downwardly from the front of the support surface 20 and has opposite end portions adjacent opposite ends of the sofa section 12. The opposite end portions of the forwardly facing surface 24 are respectively provided with nonlinear left and right surface portions 28 and 30. The left and right surface portions 28 and 30 are preferably mirror images of each other and are each nonsymmetrical about a generally vertical plane extending through the midpoint of the respective surface portions 28 and 30. As shown in FIG. 3, each of the left and right surface portions 28 and 30 preferably has a generally curvilinear configuration.

The sofa section 12 also includes a plurality of legs 32 or other suitable support members for supporting the sofa section 12 on a floor 34. Seat cushions including center and end cushions 36, 38 and 40 rest on the support surface 20 to provide comfort to a person sitting on the sofa section 12. The end cushions 38 and 40 are preferably upholstered on both sides so as to be invertible and useable on either end of the sofa section 12, as will be further explained below.

The sofa apparatus 10 also comprises means including an ottoman section 44 for extending the seating area 22 of the sofa section 12. The ottoman section 44 is invertible and includes a frame structure 46, and a pair of opposed, generally horizontal first and second surfaces 48 and 50. Each of the first and second surfaces 48 and 50 acts alternatively as an upwardly facing top surface and a downwardly facing bottom surface.

As shown in FIG. 5, the ottoman section 44 also includes a plurality of legs 52 or other suitable support members, and means for releaseably and alternatively attaching the legs 52 to the first and second surfaces 48 and 50. While various attaching means can be employed, in the illustrated construction the attaching means includes, in each of the first and second surfaces 48 and 50, a plurality of threaded bores 54. Each of the legs 52 includes an upwardly extending threaded portion 56 which is threadedly receiveable in one of the threaded bores 54. Thus, the legs 52 can be secured to whichever of the first and second surfaces 48 and 50 is intended to be the bottom surface. If the ottoman section 44 is later inverted, the legs 52 can be conveniently unscrewed and secured to the other of the first and second surfaces 48 and 50.

The ottoman section 44 also includes a generally vertical, rearwardly facing third surface portion 60 which extends between the first and second surfaces 48 and 50. The third surface portion 60 is nonlinear and is also preferably nonsymmetrical about a general vertical plane extending through the midpoint of the third surface portion 60. Like the left and right surface portions 28 and 30 of the sofa section 12, the third surface portion 60 is preferably curvilinearly configured to alternatively match each of the left and right surface portions 28 and 30.

Figure 4:
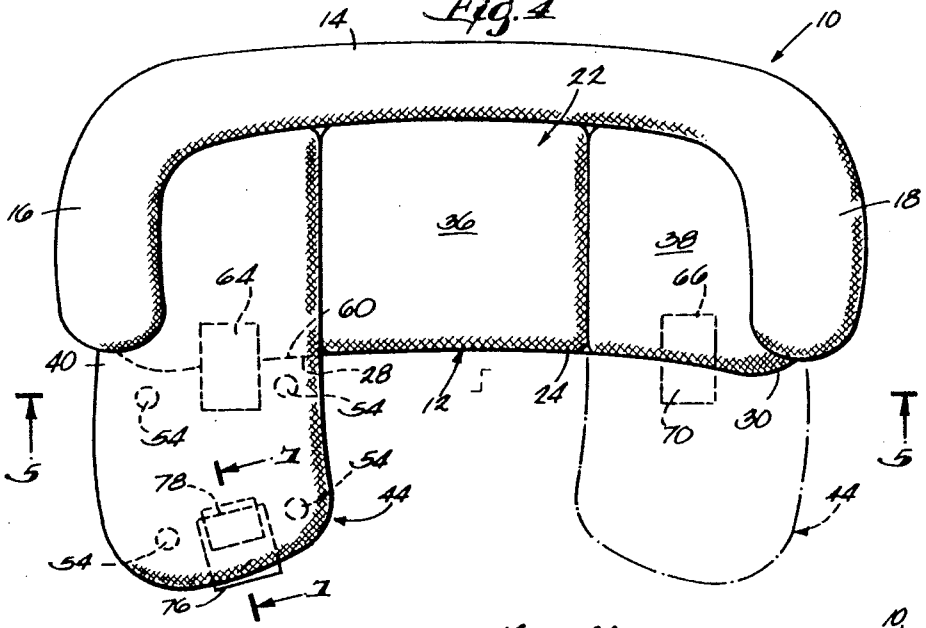
FIG. 4 is a reduced top plan view of the sofa apparatus as shown in FIG. 2.

The ottoman section 44 is positionable in a first position (shown in solid lines in FIG. 4) wherein the first surface 48 of the ottoman section 44 faces upwardly, the second surface 50 of the ottoman section 44 faces downwardly, and the third surface portion 60 is positioned in closely adjacent complementary relation with the left surface portion 28 of the sofa section to form an extension of the support surface 20 on the left end of the sofa section 12. The ottoman section 44 can also be inverted so that it is positionable in a second position (shown in broken lines in FIG. 4 and in solid lines in FIG. 3) with the second surface 50 of the ottoman section 44 facing upwardly, and with the third surface portion 60 being positioned in closely adjacent complementary relation with the second surface portion 30 to form an extension of the support surface 20 on the right end of the sofa section 12. In the first and second positions the third surface portion 60 preferably bears respectively against the left and right surface portions 28 and 30. In either position the support surface 20 is preferably coextensive and coplanar with the top surface of the ottoman section 12, whether the upwardly facing surface is the first surface 48 or the second surface 50.

The sofa apparatus 10 also includes means for detachably connecting the ottoman section 44 to the sofa section 12. While various connecting means can be employed, in the illustrated construction the connecting means includes a pair of VELCRO straps 64 and 66 fastened on opposite ends of the support surface 20 respectively adjacent the left and right surface portions 28 and 30. VELCRO tabs 68 and 70 are also respectively provided on the first and second surfaces 48 and 50 on the ottoman section 44 adjacent the third surface portion 60. Thus, depending on which end of the sofa section 12 the ottoman section 44 is located, one of the straps 64 and 66 can be fastened to one of the tabs 68 and 70.

The end cushions 38 and 40 cooperate with the sofa section 12 and the ottoman section 44 in forming the sofa apparatus 10. The end seat cushion 38 preferably has a forwardly facing surface 72 which alternatively matches the contour of the left and right surface portions 28 and 30. The end seat cushion 40 is preferably sized to fit over both the ottoman section 44 and one end of the support surface 20 to give the ottoman section 44 the appearance of a continuous extension of the seating area 22.

Figure 7:
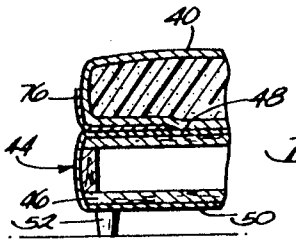
FIG. 7 is a view taken along line 7—7 in FIG. 4.

The sofa apparatus 10 comprises means for fastening the end seat cushion 40 to the ottoman section 44. While various attaching means can be employed, in the illustrated construction the attaching means includes a flap 76 secured to the front of the end cushion 40 (see FIG. 7). The flap 76 is provided with VELCRO, and each of the first and second surfaces 48 and 50 includes a VELCRO tab 78 positioned adjacent the front of the ottoman section 44. The flap 76 is alternatively attachable to the tabs 78 on the first and second surfaces 48 and 50. As shown in FIG. 7, the flap 76 extends between the end cushion 40 and the upwardly facing surface 48 or 50 of the ottoman and is held in engagement with the tab 78 by the weight of a person on the cushion 40. This assists in preventing the cushion 40 from uncovering relative to the ottoman.

Advantageously, the ottoman section 44 is positionable on either end of the sofa section 12 to form a generally L-shaped sofa apparatus 10. This is accomplished by placing the legs 52 on the one of the first and second surfaces 48 and 50 which will be the bottom of the ottoman section 44, positioning the ottoman section 44 adjacent one of the left and right surface portions 28 and 30, and positioning the end cushions 38 and 40. The ottoman section 44 has versatility to change the appearance and configuration of the sofa apparatus 10, and can include its own seat cushion (not shown) for use as a conventional ottoman. Additionally, a user of the sofa apparatus 10 need only purchase one ottoman section 44 if extension of the sofa section 12 is desired, regardless of which end of the sofa section 12 is to be extended. Also, the invertible ottoman section 44 facilitates the stocking by retailers of only a single type of ottoman section 44, as opposed to stocking different ottoman sections specifically adapted to fit the opposite ends of the sofa section 12.

Various features of the invention are set forth in the following claims.

I claim:

1. A sofa apparatus comprising a sofa section including opposite end portions each having a nonlinear, nonsymmetrical, forwardly facing surface portion, said forwardly facing surface portions being mirror images of each other, and an invertible ottoman section including opposed, generally horizontal first and second surfaces, and a nonlinear, nonsymmetrical, rearwardly facing surface portion extending between said first and second surfaces, said ottoman section being positionable in a first position wherein said first surface faces upwardly, said second surface faces downwardly, and said rearwardly facing surface portion is positioned in closely adjacent complementary relation with one of said forwardly facing surface portions, and said ottoman being positionable in a second position wherein said second surface faces upwardly, said first surface faces downwardly, and said rearwardly facing surface portion is positioned in closely adjacent complementary relation with the other of said forwardly facing surface portions.

2. A sofa apparatus as set forth in claim 1, wherein said sofa section includes a backrest portion and a generally horizontal support surface extending forwardly from said backrest portion, and wherein each of said forwardly facing surface portions extends downwardly from said support surface.

3. A sofa apparatus as set forth in claim 1, wherein said ottoman section includes a plurality of support members, and means on each of said first and second surfaces for releaseably attaching said support members, wherein said support members are attached to said second surface when said ottoman section is in said first position, and wherein said support members are attached to said first surface when said ottoman section is in said second position.

4. A sofa apparatus as set forth in claim 1, wherein said sofa apparatus further comprises means for releaseably connecting said ottoman section to said sofa section.

5. A sofa apparatus as set forth in claim 1, wherein each of said first and second surfaces and said rearwardly facing surface portion has a curvilinear configuration.

6. A sofa apparatus as set forth in claim 2, wherein said support surface defines thereabove a seating area, wherein said support surface is coextensive with said first surface when said ottoman is in said first position, and wherein said support surface is coextensive with said second surface when said ottoman is in said second position.

7. A sofa apparatus as set forth in claim 6, wherein said sofa apparatus further comprises seat cushions on said support surface, said seat cushions including an invertible first seat cushion which is alternatively positionable on opposite ends of said sofa section, wherein said first seat cushion extends over said first surface when said ottoman section is in said first position, and wherein said first seat cushion extends over said second surface when said ottoman section is in said second position.

8. A sofa apparatus as set forth in claim 7, wherein said sofa apparatus further comprises means for releaseably attaching said first seat cushion to said ottoman section.

9. An ottoman for use with sofa including opposite end portions each having a nonlinear, nonsymmetrical, forwardly facing surface portion, the forwardly facing surface portions being mirror images of each other, said ottoman comprising opposed, generally horizontal first and second surfaces, and a nonlinear, nonsymmetrical, generally vertical third surface portion extending between said first and second surfaces, said ottoman being positionable in a first position wherein said first surface faces upwardly, said second surface faces downwardly, and said third surface portion is positioned in closely adjacent complementary relation with one of the forwardly facing surface portions of the sofa, and said ottoman being positionable in a second position wherein said second surface faces upwardly, said first surface faces downwardly, and said third surface portion is positioned in closely adjacent complementary relation with the other of the forwardly facing surface portions of the sofa.

10. An ottoman as set forth in claim 9, wherein said ottoman further comprises a plurality of support members, and means for releaseably attaching said support members to said first surface and to said second surface, wherein said support members are attached to said first surface when said ottoman is in said first position, and wherein said support members are attached to said second surface when said ottoman is in said second position.

11. An ottoman as set forth in claim 9, wherein said ottoman includes means for releaseably attaching said ottoman to the sofa.

12. An ottoman as set forth in claim 9, wherein said third surface portion has a curvilinear configuration.

13. A device for converting a sofa including a generally horizontal support surface adapted to support a cushion, said device comprising an invertible ottoman which is separate from the sofa and which includes opposed, generally horizontal first and second surfaces, each of said first and second surfaces having therein a plurality of threaded bores, and one of said first and second surfaces being upwardly facing, a plurality of support members, each one of said support members including a threaded projection which is threadedly receivable in one of said threaded bores to attach said one support member to one of said first and second surfaces, whereby said first surface faces upwardly when said support members are attached to said second surface, and whereby said second surface faces upwardly when said support members are attached to said first surface, and a seat cushion extending over and supported by said upwardly facing surface of said ottoman and adapted to extend over and be supported by the support surface of the sofa.

* * * * *